US005409796A

United States Patent [19]

Fuller et al.

[11] Patent Number: 5,409,796

[45] Date of Patent: Apr. 25, 1995

[54] LIQUID DEVELOPER COMPOSITIONS WITH QUATERNIZED POLYAMINES

[75] Inventors: Timothy J. Fuller, Pittsford; James R. Larson, Fairport; John W. Spiewak, Webster; David H. Pan, Rochester; Ralph A. Mosher, Rochester; Frank J. Bonsignore, Rochester, all of N.Y.

[73] Assignee: Xerox Corporation, Stamford, Conn.

[21] Appl. No.: 200,988

[22] Filed: Feb. 24, 1994

[51] Int. Cl.[6] ..... G03G 9/097

[52] U.S. Cl. ..... 430/115; 430/114; 430/904

[58] Field of Search ..... 430/115, 114, 904

[56] References Cited

U.S. PATENT DOCUMENTS

| | | | |
|---|---|---|---|
| 4,707,429 | 11/1987 | Trout | 430/115 |
| 5,019,477 | 5/1991 | Felder | 430/115 |
| 5,026,621 | 6/1991 | Tsubuko et al. | 430/109 |
| 5,030,535 | 7/1991 | Drappel et al. | 430/116 |
| 5,035,972 | 7/1991 | El-Sayed et al. | 430/114 |
| 5,045,424 | 9/1991 | Rimai et al. | 430/126 |
| 5,106,717 | 4/1992 | Houle et al. | 430/115 |
| 5,290,653 | 3/1994 | Pearlstine | 430/115 |

FOREIGN PATENT DOCUMENTS

| | | | |
|---|---|---|---|
| 1-216366 | 8/1989 | Japan | 430/115 |

OTHER PUBLICATIONS

*General Chemistry*, Third Edition, Brady et al., p. 705 (1982).

*Primary Examiner*—Christopher D. Rodee

*Attorney, Agent, or Firm*—E. O. Palazzo

[57] ABSTRACT

A positively charged liquid developer comprised of thermoplastic resin particles, optional pigment, a charge director, and a charge adjuvant comprised of a polymer of an alkene and unsaturated acid derivative; and wherein the acid derivative contains pendant ammonium groups, and wherein the charge adjuvant is associated with or combined with said resin and said optional pigment.

An example of a charge adjuvent copolymer compound containing alkylene and an unsaturated acid derivative such as acrylic acid and methacrylic acid containing pendent ammonium groups is represented, for example, by the following general formula

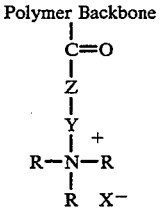

wherein Z is oxygen or substituted nitrogen; Y is alkyl; R is hydrogen, alkyl or aryl; and X is an anion.

15 Claims, No Drawings

LIQUID DEVELOPER COMPOSITIONS WITH QUATERNIZED POLYAMINES

BACKGROUND OF THE INVENTION

This invention is generally directed to liquid developer compositions and, more specifically, the present invention relates to a liquid developer containing a copolymer of an alkene and unsaturated acid derivatives, such as acrylic acid and methacrylic acid derivatives, and further containing pendant ammonium groups, and which copolymers are functioning as charge adjuvants. More specifically, the present invention relates to positively charged liquid developers comprised of a suitable carrier liquid and an insoluble charge adjuvant comprised of copolymers of alkylene, such as those with from 1 to about 25 carbon atoms like ethylene and methacrylic acid esters with the ester groups having pendant ammonium groups, such as N,N,N-trimethyl-ammonium bromide, N,N-dimethylamine hydrogen bromide, N,N,N-trimethylammonium tosylate (p-toluenesulfonate), and N,N-dimethylamine hydrogen tosylate, N,N,-dimethylamine hydrogen dinonylnaphthalene sulfonate, and the like covalently bonded thereto The developers of the present invention can be selected for a number of known imaging systems, such as xerographic imaging and printing processes, wherein latent images are rendered visible with the liquid developers illustrated herein. The image quality, solid area coverage and resolution for developed images usually require, for example, sufficient toner particle electrophoretic mobility. The mobility for effective image development is primarily dependent on the imaging system used, and such electrophoretic mobility is directly proportional to the charge on the toner particles and inversely proportional to the viscosity of the liquid developer fluid. For example, an about 10 to 30 percent change in fluid viscosity caused for instance by an about 5° to 15° C. decrease in temperature could result in a decrease in image quality, poor or unacceptable image development and undesirable background development, for example, because of a 5 percent to 23 percent decrease in electrophoretic mobility. Insufficient particle charge can also result in poor, or no transfer of the toner to paper or other substrates. Poor transfer, for example, can result in poor solid area coverage if insufficient toner is transferred to the final substrate, and can also result in image defects such as smearing and hollowed fine features. To overcome or minimize such problems, the liquid toners of the present invention were arrived at after extensive research efforts, and which toners result in, for example, sufficient particle charge, generally corresponding to an ESA mobility equal to greater than about +2.0 E-10 $m^2/Vs$ for excellent transfer and maintaining the mobility within the desired range of the particular imaging system employed. Advantages associated with the present invention include improvements in the desired positive charge on the developer particles; in some instances the improvement, as measured by ESA mobility, is from +1.5 E-10 $M^2/Vs$ without the copolymers of ethylene and methacrylic acid esters with the ester groups having pendant ammonium groups to +3.5 E-10 $M^2/Vs$ when the copolymers of ethylene and methacrylic acid esters with the ester groups having pendant ammonium groups charge adjuvants of the present invention are selected. The greater toner charge results in, for example, improved image development and higher quality images, such as higher resolutions with less background deposits.

A latent electrostatic image can be developed with toner particles dispersed in an insulating nonpolar liquid. The aforementioned dispersed mixture is known as a liquid toner or liquid developer. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of about $10^9$ ohm-centimeters, a low dielectric constant, for example below about 3.0, and a high vapor pressure. Generally, the toner particles are less than about 10 μm (microns) average by area size as measured with the Horiba 700 Particle Sizer.

Since the formation of proper images depends primarily on the difference of the charge between the toner particles in the liquid developer and the latent electrostatic image to be developed, it is desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant. A charge director can be of importance in controlling the charging properties of the toner to enable excellent quality images.

In U.S. Pat. No. 5,035,972, the disclosure of which is totally incorporated herein by reference, there are illustrated liquid developers with quaternized ammonium AB diblock copolymer charge directors, and wherein the nitrogen in the ionic A block is quaternized with an alkylating agent.

In U.S. Pat. No. 5,019,477, the disclosure of which is hereby totally incorporated herein by reference, there is illustrated a liquid electrostatic developer comprising a nonpolar liquid, thermoplastic resin particles, and a charge director. The ionic or zwitterionic charge directors selected may include both negative charge directors, such as lecithin, oil-soluble petroleum sulfonate and alkyl succinimide, and positive charge directors, such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) a component selected from the group consisting of butadiene and acrylate. As the copolymer of polyethylene and methacrylic acid or methacrylic acid alkyl esters, NUCREL® may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to 120° C., adding pigment to the hot polymer solution, attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) of at least one of a fluoroalkylacryl ester block unit or a fluoroalkyl methacryl ester block unit, and a compatible segment (13) of a fluorine-free vinyl or olefin monomer block unit. The functional segment of block copolymer is oriented to the surface of the block polymer and the compatible segment thereof is oriented to be compatible with other resins and a coloring agent contained in the toner, whereby the toner is provided with both liquid-repelling and solvent-soluble properties.

In U.S. Pat. No. 4,707,429 there are illustrated, for example, liquid developers with an aluminum stearate charge adjuvant. Liquid developers with charge directors are illustrated in U.S. Pat. No. 5,045,425. Also, stain elimination in consecutive colored liquid toners is illustrated in U.S. Pat. No. 5,069,995.

In copending U.S. patent application Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., the developer having a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. Nos. 5,306,591 and 5,308,731, the disclosures of which are totally incorporated herein by reference, there is illustrated a liquid developer comprised of thermoplastic resin particles, a charge director, and a charge adjuvant comprised of an imine bisquinone; and a liquid developer comprised of a liquid, thermoplastic resin particles, a nonpolar liquid soluble charge director, and a charge adjuvant comprised of a metal hydroxycarboxylic acid, respectively. In copending patent application U.S. Ser. No. 065,414, the disclosure of which is totally incorporated herein by reference, there is illustrated a liquid developer comprised of thermoplastic resin particles, and a charge director comprised of an ammonium AB diblock copolymer of the formula

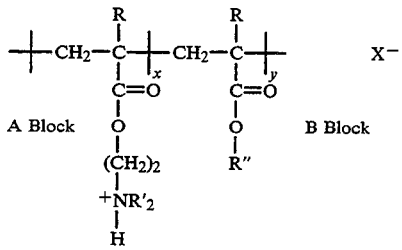

wherein X− is a conjugate base or anion of a strong acid; R is hydrogen or alkyl; R′ is alkyl, R″ is an alkyl group containing from about 6 to about 20 carbon atoms; and y and x represent the number average degree of polymerization (DP) wherein the ratio of y to x is in the range of from about 10 to 2 to about 100 to 20. The charge adjuvants and other appropriate components of these copending applications may be selected for the liquid toners of the present invention.

In copending U.S. application Ser. No. 204,012, the disclosure of which is totally incorporated herein by reference, there is illustrated a negatively charged liquid developer comprised of thermoplastic resin particles, optional pigment, a charge director, an insoluble charge adjuvant, and a copolymer comprised of an alkene and unsaturated acid derivative and wherein the acid derivative contains pendant fluoroalkyl or pendant fluoroaryl groups, and wherein the charge adjuvant is associated with or combined with said resin and said optional pigment, and the copolymer is of the formula

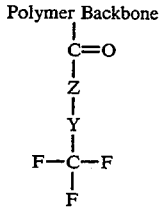

wherein Z is oxygen or nitrogen; Y is $(—CH_2—)_x$, ether or fluorinated ether, $(—CF_2—)_x$, $(—CH_2—)_x—(—CF_2—)_y$, aryl, fluorinated aryl, alkyl or fluorinated alkyl, cycloaliphatic, or fluorinated cycloaliphatic.

SUMMARY OF THE INVENTION

It is an object of the present invention to provide a liquid developer with many of the advantages illustrated herein.

Another object of the present invention resides in the provision of liquid developers capable of high particle charging.

Another object of the invention is to provide positively charged liquid developers wherein there are selected as charge adjuvants, or charge additives copolymers of an alkene and unsaturated acid derivatives, such as acrylic acid and methacrylic acid derivatives, containing pendant ammonium groups.

It is a further object of the invention to provide positively charged liquid developers wherein there are selected as charge adjuvants, or charge additives copolymers of ethylene and an $\alpha$-$\beta$-ethylenically unsaturated acid selected from the group consisting of acrylic acid and methacrylic acid derivatives containing pendant ammonium groups.

It is still a further object of the invention to provide a liquid developer wherein developed image defects such as smearing, loss of resolution and loss of density are eliminated or minimized, and wherein there are selected economical charge directors that permit toners that can be easily transferred from imaging members such as photoreceptor drums.

Also, in another object of the present invention there are provided improved positively charged liquid developers with certain charge directors.

Another object of the present invention resides in the provision of liquid developers with known additives and adjuvants.

Further, in another object of the present invention there are provided in embodiments liquid developers with modified charge adjuvant polymers, such as NUCREL 599®, modified with quaternary ammonium groups or fluoro containing components to, for example, thereby control the charging properties of the resin particles present in liquid immersion development inks. For example, the trifluoroethylester of NUCREL 599® with HBr quaternary salt director can cause strongly negative charging of the liquid ink particles, and the trimethyl ammonium ethyl ester bromide of NUCREL 599® charges the ink strongly positive, especially with an Alohos charge director, reference U.S. Pat. No. 5,223,368, the disclosure of which is totally incorporated herein by reference. The modified NUCREL® components may be selected as the main resin ingredient for liquid developers, or as charge control additives for other NUCREL® based resins and inks.

These and other objects of the present invention can be accomplished in embodiments by the provision of liquid developers with certain charge adjuvants comprised of copolymers of an alkene and an unsaturated acid derivative, such as acrylic acid and methacrylic acid derivatives, and which copolymers contain pendant ammonium groups. In embodiments, the present invention is directed to positively charged liquid developers comprised of a toner resin, pigment, and a charge adjuvant comprised of certain copolymers of an alkene and unsaturated acid derivatives, such as acrylic acid and methacrylic acid derivatives, containing pendant ammonium groups covalently attached thereto and wherein the charge adjuvant copolymer is comprised of from about 1 to about 100 weight percent and preferably from about 10 to about 50 weight percent of the toner composition.

An example of a general formula that can be utilized to illustrate the charge adjuvant compound copolymers of an alkene and unsaturated acid derivatives, such as acrylic acid and methacrylic acid derivatives, containing pendant ammonium groups of the present invention is as follows

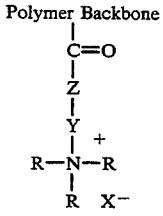

wherein the substituents such as R, Z, Y and X are as illustrated herein.

The polymer backbone is in embodiments comprised of a copolymer of an alkene and an unsaturated acid, such as acrylic acid and methacrylic acid, wherein the spacer Z is oxygen or a substituted nitrogen. In the situation where Z is oxygen, the backbone acid derivative is an ester. In the situation where Z is substituted nitrogen, the backbone acid derivative is an amide. The nitrogen of the amide can be bonded to hydrogen, an alkyl group of about 1 to 20 carbons, an aryl or alkyl aryl group with 6 to about 24 carbons as more specifically illustrated herein. The spacer Y is an alkyl group with a carbon chain length of from about 2 to about 20 carbons, and the carbon chain may contain a ring such as cyclohexyl, aryl or alkylaryl with from about 6 to about 24 carbon atoms such as phenyl, benzyl, napthyl, anthryl, 2-phenylethylene, and the like. The pendent ammonium group may be incorporated in an aromatic or nonaromatic ring structure, such as a pyridinium or a piperidinium ring, or may be acyclic such as 2-ammonium ethylene. The substituents on the ammonium nitrogen, R, can be hydrogen, an alkyl group of 1 to about 20 carbons, an aryl, or alkyl aryl group of 6 to 24 carbons. Examples of R groups on the ammonium nitrogen include hydrogen, methyl, ethyl, propyl, isopropyl, butyl, iso-butyl, secondary butyl, octyl, hexadecyl, benzyl, phenyl, naphthyl, and the like. Examples of X anions include fluoride, chloride, bromide, iodide, sulfate, bisulfate, p-toluenesulfonate, phosphate, trifluoroacetate, trichloroacetate, tribromacetate, dicloroacetate, difluoroacetate, methhylsulfonate, ethylsulfonate, tetrafluorborate, nitrate, dinonylnaphthalenesulfonate, dodecylbenzenesulfonate, tetrafluoroborate, and the like.

In embodiments, substituents for the Z substituted nitrogen can be generally alkyl with 1 to about 25 carbon atoms, aryl with from 6 to about 30 carbon atoms, or mixtures thereof.

Examples of polymer backbones include ethylene vinyl acetate (EVA) copolymers, (ELVAX® resins, E. I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); ethylene ethyl acrylate series available under the trademark BAKELITE® DPD 6169, DPDA 6182 NATURAL TM (Union Carbide Corporation, Stamford, Conn.); SURLYN® ionomer resin (E. I. DuPont de Nemours and Company), poly(propylene-acrylic acid), poly(methylvinylether-maleic acid), poly(propylene-ethylene-acrylic acid), poly(styrene-maleic anhydride), poly(octadecene-maleic anhydride); or blends thereof. Preferred backbone copolymers selected in embodiments are comprised of the copolymer of ethylene and an $\alpha$-$\beta$-ethylenically unsaturated acid of either acrylic acid or methacrylic acid. In one preferred embodiment, NUCREL® resins available from E. I. DuPont de Nemours and Company like NUCREL 599®, NUCREL 699®, or NUCREL 960® are selected as the polymer backbone. Other preferred polymer backbones include PRIMACORE® resins available from Dow Chemical Company, ACLYN® resins available from Allied Chemical Company, and Gulf PE 2207 (a 20 weight percent methyl acrylate-ethylene copolymer available from Chevron).

In embodiments, the present invention is directed to positively charged liquid developers comprised of toner resin, pigment, and a charge adjuvant comprised of copolymers of ethylene and methacrylic acid esters with the ester groups having pendant ammonium groups such as N,N,N-trialkylammonium halide, N,N,N-trimethyl-ammonium-bromide, N,N-dimethylamine hydrogen bromide, N,N,N-trimethylammonium tosylate, N,N-dimethylamine hydrogen tosylate, N,N-dimethylamine hydrogen dinonylnaphthalene sulfonate and the like. Examples of charge adjuvants include the copolymer of ethylene and N,N,N-trimethylammonium-2-ethylmethacrylate bromide, the copolymer of ethylene and N,N,N-trimethylammonium-2-ethylmethacrylate tosylate, the copolymer of ethylene and N,N,N-trimethylammonium-2-ethylmethacrylate chloride, the copolymer of ethylene and N,N,N-trimethylammonium-2-ethylmethacrylate fluoride, the copolymer of ethylene and N,N,N-trimethylammonium-2-ethylmethacrylate trifluoroacetate, the copolymer of ethylene and N,N,N-trimethylammonium-2-ethylmethacrylate sulfate, the copolymer of ethylene and N,N,N-trimethylammonium-2-ethylmethacrylate phosphate, the copolymer of ethylene and N,N,N-trimethylammonium-2-ethylmethacrylate dinonylnaphthalenesulfonate, the copolymer of ethylene and N,N,N-trimethylammonium-2-ethylmethacrylate dodecylbenzenesulfonate, the copolymer of ethylene and N,N,N-triethylammonium-2-ethylmethacrylate bromide, the copolymer of ethylene and N,N,N-triethylammonium-2-ethylmethacrylate tosylate, the copolymer of ethylene and N,N,N-triethylammonium-2-ethylmethacrylate chloride, the copolymer of ethylene and N,N,N-triethylammonium-2-ethylmethacrylate fluoride, the copolymer of ethylene and N,N,N-triethylammonium-2-ethylmethacrylate trifluoroacetate, the copolymer of ethylene and N,N,N-triethylammonium-2-ethylmethacrylate sulfate, the copolymer of ethylene and N,N,N-triethylammonium-2-ethylmethacrylate phosphate, the copolymer of ethylene and N,N,N-triethylammonium-2-ethylmethacrylate dinonylnaphthalenesulfonate, the copolymer of ethylene and N,N,N-triethylammonium-2-ethylmethacrylate dodecylbenzenesulfonate, the copolymer of ethylene and N,N-dimethylammonium-2-ethylmethacrylate hydrogen bromide, the copolymer of ethylene and N,N-dimethylammonium-2-ethylmethacrylate hydrogen tosylate, the copolymer of ethylene and N,N-dimethylammonium-2-ethylmethacrylate hydrogen chloride, the copolymer of ethylene and N,N-dimethylammonium-2-ethylmethacrylate fluoride, the copolymer of ethylene and N,N-dimethylammonium-2-ethylmethacrylate hydrogen trifluoroacetate, the copolymer of ethylene and N,N-dimethylammonium-2-ethylmethacrylate hydrogen trichloroacetate, the copolymer of ethylene and N,N-dimethylammonium-2-ethylmethacrylate hydrogen dinonylnaphthalenesulfonate, or copolymer of ethylene and N,N-dimethylammonium-2-ethylmethacrylate hydrogen dodecylbenzenesulfonate.

Embodiments of the present invention include a liquid developer comprised of thermoplastic resin particles, and a charge adjuvant comprised of polymers of an alkene and unsaturated acid derivatives, such as acrylic acid and methacrylic acid derivatives, containing pendant ammonium groups as illustrated herein; a liquid developer comprised of a liquid component, thermoplastic resin; a charge adjuvant comprised of certain copolymers of an alkene and unsaturated acid derivatives, such as acrylic acid and methacrylic acid derivatives, containing pendant ammonium groups, a charge director compound as illustrated herein; and a liquid electrostatographic developer comprised of (A) a nonpolar liquid having viscosity of from about 0.5 to about 20 centipoise and resistivity about equal to or greater than $5\times10^9$ ohm-cm with a preferred range of from about $10^{10}$ to about $10^{14}$ ohm-cm; (B) thermoplastic resin particles with an average volume particle diameter of from about 0.1 to about 30 microns; (C) a charge adjuvant comprised of certain copolymers of an alkene and unsaturated acid derivatives, such as acrylic acid and methacrylic acid derivatives, containing pendant ammonium groups as illustrated herein, and wherein the charge adjuvant is associated with or combined, preferably permanently, with the resin and pigment; and (D) a charge director compound.

In embodiments, the present invention relates to a liquid developer comprised of, in effective amounts thermoplastic resin particles, and a charge adjuvant present in various effective amounts, such as from about 1 to about 99, and preferably from 3 to about 50 weight percent, comprised of copolymers of an alkene and unsaturated acid derivatives, such as acrylic acid and methacrylic acid derivatives, containing pendant ammonium groups as illustrated herein.

A positively charged liquid developer of the present invention having a charge sufficient to result in a particle mobility about equal to or greater than $2.0\times10-10$ $M^2/Vs$ and preferably about equal to or greater than $2.50\times10-10$ $M^2/Vs$ as measured with the Matec ESA apparatus is, for example, comprised of a liquid component, optional thermoplastic resin, and a charge adjuvant comprised of copolymers of an alkene and unsaturated acid derivatives, such as acrylic acid and methacrylic acid derivatives, containing pendant ammonium groups and the like, which adjuvants are present in various effective amounts such as, for example, from about I to about 100 weight percent of the liquid toner solids which include resin, optional pigment and charge adjuvant, and a charge director; and a liquid electrostatographic developer comprised of (A) a liquid having viscosity of from about 0.5 to about 20 centipoise and resistivity greater than $5\times10^9$; (B) thermoplastic resin particles with an average volume particle diameter of from about 0.1 to about 30 microns; (C) a charge adjuvant comprised of certain copolymers of an alkene and unsaturated acid derivatives, such as acrylic acid and methacrylic acid derivatives, containing pendant ammonium groups as illustrated herein; and (D) a charge director.

In embodiments, it is important that the toner particle be comprised of the optional thermoplastic resin, the charge adjuvant, and the optional pigment. Therefore it is important that the thermoplastic resin and the charge adjuvant be sufficiently compatible that they do not form separate particles and that the charge adjuvant be insoluble in the hydrocarbon to the extent that no more than 0.1 weight percent is soluble in the nonpolar liquid.

The charge director can be selected for the liquid developers in various effective amounts, such as for example in embodiments from about 5 to 1,000 milligrams charge director per gram of toner solids and preferably 10 to 100 milligrams/gram. Developer solids include toner resin, optional pigment, and charge adjuvant. Without pigment, the developer may be selected for the generation of a resist, a printing plate, and the like.

Examples of effective charge directors for positively charged liquid toner particles include anionic glyceride, such as EMPHOS D70-30C® and EMPHOS F27-85®, two products available from Witco Corporation, New York, N.Y., which are sodium salts of phosphated mono- and diglycerides with saturated and unsaturated substituents, respectively; EMPHOS PS900® available from Witco Corporation, New York, N.Y., which is one of a comprehensive anionic series of complex organic phosphate esters; lecithin, Neutral Barium Petronate, Calcium Petronate, Neutral Calcium Petronate, oil soluble petroleum sulfonates, Witco Corporation, New York, N.Y., and metallic soap charge directors, such as aluminum tristearate, aluminum distearate, barium, calcium, lead, and zinc stearates; cobalt, manganese, lead, and zinc lineolates, aluminum, calcium, and cobalt octoates; calcium and cobalt oleates; zinc palmitate; calcium, cobalt, manganese, lead, and zinc resinates, and hydroxy bis(3,5-di-tert-butyl salicyclic) aluminate monohydrate, a mixture of hydroxy bis(3,5-di-tert-butyl salicyclic) aluminate monohydrate and EMPHOS PS-900®; and the like. Other effective positive charge directors include AB diblock copolymers of 2-ethylhexylmethacrylate-co-methacrylic acid calcium and ammonium salts as illustrated in U.S. Pat. No. 5,130,221, the disclosure of which is totally incorporated herein by reference.

Examples of liquid carriers, or nonpolar liquids, selected for the developers of the present invention include a liquid with an effective viscosity as measured, for example, by a number of known methods, such as capillary viscometers, coaxial cylindrical rheometers, cone and plate rheometers, and the like of, for example, from about 0.5 to about 500 centipoise, and preferably from about 1 to about 20 centipoise, and a resistivity equal to or greater than about $5\times10^9$ ohm-cm, such as $5\times10^{13}$. Preferably, the liquid selected is a branched chain aliphatic hydrocarbon as illustrated herein. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling point range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto-ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR ®M has a flash point of 80° C. as determined by the ASTM D-56 method. The liquids selected should have an electrical volume resistivity in excess of $10^9$ ohm-centimeters and a dielectric constant below 3.0. Moreover, the vapor pressure at 25° C. should be less than 10 Torr in embodiments. The amount of liquid carrier or nonpolar liquid is 75 to 99.9 weight percent and preferably between 95 and 99 weight percent.

Although in embodiments the ISOPAR® series liquids are the preferred nonpolar liquids for use as dispersants in the liquid developers of the present invention, the essential characteristics of viscosity and resistivity may be achieved with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 75 percent to about 99.9 percent, and preferably from about 95 to about 99 percent by weight of the total developer dispersion. The total solid components content of the developer is, for example, from about 0.1 to about 25 percent by weight, and preferably from about 1.0 to about 5 percent.

Typical suitable thermoplastic toner resin can be selected for the liquid developers of the present invention in effective amounts of, for example, in the range of about 99 percent to about 40 percent, and preferably from about 95 percent to about 70 percent of developer solids comprised of thermoplastic resin, pigment, charge adjuvant, and in embodiments other optional components, such as magnetic materials, like magnetites that may comprise the developer. Generally, developer solids include the thermoplastic resin, optional pigment and charge adjuvant. Examples of thermoplastic resins include ethylene vinyl acetate (EVA) copolymers, (ELVAX® resins, E. I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 NATURAL™ (Union Carbide Corporation, Stamford, Conn.); ethylene vinyl acetate resins like DQDA 6832 NATURAL 7™ (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid (optional but preferred), and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers selected in embodiments are comprised of the copolymer of ethylene and an $\alpha$-$\beta$-ethylenically unsaturated acid of either acrylic acid or methacrylic acid. In a preferred embodiment, NUCREL® resins available from E. I. DuPont de Nemours and Company like NUCREL 599®, NUCREL 699®, or NUCREL 960® are selected as the thermoplastic resin.

The liquid developer of the present invention preferably contains a colorant dispersed in the resin particles. Colorants, such as pigments or dyes like black, cyan, magenta, yellow, red, blue, green, brown, and mixtures, such as wherein any one colorant may comprise from 0.1 to 99.9 weight percent of the colorant mixture with another or other colorants comprising the remaining percentage thereof are preferably present to render the latent image visible.

The colorant may be present in the resin particles in an effective amount of, for example, from about 0.1 to about 60 percent, and preferably from about 10 to about 30 percent by weight based on the total weight of solids contained in the developer. The amount of colorant used may vary depending on the use of the developer, for instance if the toned image is to be used to form a chemical resist image no pigment is necessary. Examples of pigments which may be selected include carbon blacks available from, for example, Cabot Corporation (Boston, Mass.), such as MONARCH 1300 ®, REGAL 330 ® and BLACK PEARLS ®, and color pigments like FANAL PINK", PV FAST BLUE TM, and Paliotol Yellow D1155; pigments as illustrated in U.S. Pat. No. 5,223,368, the disclosure of which is totally incorporated herein by reference; and the following list of examples

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® RANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |

-continued

| PIGMENT BRAND NAME | MANUFACTURER | COLOR |
|---|---|---|
| HELIOGEN ® BLUE L7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, Cl 77266 |
| UHLICH ® BK 8200 | Paul Uhlich | Black |

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning. Toner particle mobility can be measured using the electroacoustics effect, the application of an electric field, and the measurement of sound described in U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is for example high mobilities have been shown to result in improved image density, higher image resolution and superior transfer efficiency, for example U.S. Pat. Nos. 5,066,821, 5,034,299, and 5,028,508, the disclosures of which are totally incorporated herein by reference. Residual conductivity, that is the conductivity from the charge director, can be measured with a low field device as described in the Examples.

To increase the toner particle charge and, accordingly, increase the mobility and transfer latitude of the toner particles, the prior art selects charge adjuvants that are added to the toner particles. For example, adjuvants, such as metallic soaps like aluminum or magnesium stearate or octoate, fine particle size oxides, such as oxides of silica, alumina, titania, and the like, paratoluenesulfonic acid, and polyphosphoric acid, may be added. Negative charge adjuvants increase the negative charge of the toner particle, while the positive charge adjuvants increase the positive charge of the toner particles. With the invention of the present application, the adjuvants or charge additive can be copolymers of an alkene and unsaturated acid derivatives, such as acrylic acid and methacrylic acid derivatives, containing pendant ammonium groups as charge adjuvants including copolymers of ethylene and methacrylic acid esters with the ester groups having pendant ammonium groups such as copolymer of ethylene and N,N,N-trimethylammonium-2-ethylmethacrylate bromide, copolymer of ethylene and N,N,N-trimethylammonium-2-ethylmethacrylate tosylate, copolymer of ethylene and N,N-dimethylammonium-2-ethylmethacrylate hydrogen tosylate, copolymer of ethylene and N,N-dimethylammonium-2-ethylmethacrylate hydrogen bromide, copolymer of ethylene and N,N-dimethylammonium-2-ethylmethacrylate hydrogen dinonylnaphthalenesulfonate, and the like. The adjuvants can be added to the liquid toner particles in an amount of from about 1 percent to about 100 percent of the total developer solids of toner resin, pigment, and charge adjuvant, and preferably from about 10 percent to about 50 percent of the total weight of solids contained in the developer. When the charge adjuvants of the present invention with pendant ammonium groups are employed, a positively charged liquid developer is obtained having a charge sufficient to result in a particle mobility greater than $2.0\times10-10$ $M^2/Vs$ and preferably greater than $2.50\times10-10$ $M^2/Vs$ as measured with the Matec ESA apparatus.

The liquid electrostatic developer of the present invention can be prepared by a variety of known processes, such as, for example, mixing, in a nonpolar liquid with the thermoplastic resin, charge additive or adjuvant, and optional colorant in a manner that the resulting mixture contains about 15 to about 30 percent by weight of solids, which solids include the resin in an amount range of from 0 to about 99 percent, preferably from about 40 percent to about 90 percent, of the solids, pigment, in the amount range of 0 to 60 percent, preferably from about 5 to about 40 percent, of the solids, and charge adjuvant in an amount range of from about 1 to about 100 percent, preferably from about 10 to about 50 percent, of the solids, heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding charge director compound to the dispersion; and diluting the dispersion to 1 percent to 2 percent solids.

In the initial mixture, the resin, colorant and charge adjuvant may be added separately to an appropriate vessel which can vary in size from 50 milliliters to 1,000 liters such as, for example, an attritor, heated ball mill, heated vibratory mill, such as a Sweco Mill (manufactured by Sweco Company, Los Angeles, Calif.) equipped with particulate media for dispersing and grinding, a Ross double planetary mixer (manufactured by Charles Ross and Son, Hauppauge, N.Y.), or a two roll heated mill, which requires no particulate media. Useful particulate grinding media include materials like a spherical cylinder selected from the group consisting of stainless steel, carbon steel, alumina, ceramic, zirconia, silica and siilimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, adjuvant and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, and glycols, such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778 and 4,783,389, the disclosures of which are totally incorporated herein by reference.

Embodiments of the invention will be illustrated in the following nonlimiting Examples, it being understood that these Examples are intended to be illustrative only and that the invention is not intended to be limited to the materials, conditions, process parameters and the like recited herein. The conductivity of the liquid toner dispersions and charge director solutions was determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to provide an ESA signal corresponding to a zeta potential of-26 millivolts for a 10 percent (v/v) suspension of LUDOX TM (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzers manufactured by Horiba Instruments, Inc, Irvine, Calif.

Image quality of developer embodiments of the invention was determined on a modified Savin 870 copier. This device comprises a Savin 870 copier with the modifications described below.

1) Disconnecting the image density feedback loop from the development electrode and connecting the electrode to a Trek Model 610 high voltage power supply (Trek, Medina, N.Y.).
2) Disconnecting the transfer corona and connecting same to a Trek Model 610 high voltage power supply (Trek, Medina, N.Y.).

To evaluate positive developers, this system was operated with a reverse image target with white characters on a black background such that the image had a positive voltage less than the development voltage and the background had a positive voltage greater than the image voltage thus resulting in the positive particles being pushed selectively onto the image area. Development voltage was 1,000 volts. Transfer to paper (Xerox 4024 paper) was conducted at −6,500 volts. Print density was measured using a Macbeth RD918 Reflectance Densitometer.

EXAMPLE I

Preparation of NUCREL 599®—Acid Chloride (26383-104-1):

In accordance with U.S. Pat. No. 4,681,831, the disclosure of which is totally incorporated herein by reference, a 3-neck, 1-liter flask equipped with a reflux condenser, argon inlet, Dean-Stark trap, syringe septum, and a mechanical stirrer was charged with NUCREL 599® (50 grams) and toluene (500 milliliters). A silicone oil bath at 140° C. was used to heat the flask to remove 40 milliliters of cloudy distillate. The reaction was then cooled to 63° C. and oxalyl chloride (9 grams) was added. After 1 hour at 60° C., a 25 milliliter aliquot sample was removed and dried in vacuo at 50° C. for 16 hours. A FTIR spectrum of the resulting solid residue revealed 3 carbonyl absorbances. The predominant absorbance peak at 1,799 $cm^{-1}$ was assigned to the acid chloride of NUCREL 599®. The product was polyethylene->(greater than)3.4-mol percent-methacrylyl chloride copolymer.

EXAMPLE II

Preparation of NUCREL 599®®—N,N-Dimethylaminoethyl Ester (26383-104-20):

A 3-neck, 1-liter flask, equipped with a reflux condenser, argon inlet, Dean-Stark trap, syringe septurn, and a mechanical stirrer was charged with NUCREL 599® (50 grams) and toluene (500 milliliters). A silicone oil bath at 140° C. was used to remove 40 milliliters of a cloudy distillate from the reaction vessel. The reaction mixture was then cooled to 63° C. and oxalyl chloride (9 grams) was added. After 1 hour at 63° C., N,N-dimethylaminoethanol (100 milliliters, 89.0 grams) was added, and the reaction temperature was increased to 75° C. After 20 hours at 75° C., the reaction was 97 percent completed as determined by FTIR spectroscopy. The reaction was allowed to proceed for 50 hours at 75° C. before the hot solution was added to methanol, about 1,000 milliliters, to precipitate a polymer which was isolated by filtration, washed with methanol using a Waring blender, and then vacuum dried to yield 52.7 grams of white powder (26383-104-50), identified as the dimethylaminoethyl ester of NUCREL 599®. The product was polyethylene-3.4-mol percent-N,N-dimethylaminoethyl methacrylate copolymer.

EXAMPLE III

Reaction of Methyl Bromide with NUCREL 599®-N,N-Dimethylaminoethyl Ester (26384-10):

NUCREL 599®-N,N-dimethylaminoethyl ester (26383-104-50, 30 grams) was combined with toluene (150 grams) in a 500 milliliter capacity Parr pressure reaction vessel. The suspension was then chilled in a dry ice bath, and then 200 milliliters of 2-molar methyl bromide (38.0 grams, 10-molar equivalents) in t-butyl methyl ether were added. The pressure vessel was gently purged, sealed, and then pressurized to 60 psi with argon. The reactor was heated at 100° C. for 16 hours with continued stirring. The reactor was cautiously vented, and the contents were added rapidly to 2 liters of methanol. The polymeric product that precipitated was isolated by filtration, washed with methanol, about 1,000 milliliters, and then vacuum dried to yield 30 grams of white polymer, identified as the adduct of methyl bromide with the dimethylaminoethyl ester of NUCREL 599®. The product was polyethylene->3.1-mol percent-N,N,N-trimethylammonium-2-ethylmethacrylate bromide copolymer.

EXAMPLE IV

12-Liter Scale Preparation of N,N-Dimethylaminoethyl Ester of NUCREL 599®(26384-73):

A 12-liter, round-bottom, 3-neck flask equipped with a reflux condenser, argon inlet, distillation take-off head, thermometer, glass stopper, and a mechanical stirrer was charged with NUCREL 599® (600 grams) and toluene (6 liters, 5,203 grams). A heating mantle was used to heat the flask to remove 477.5 grams of distillate which was initially cloudy and then became clear. The reaction solution was then cooled to 60° C. and oxalyl chloride (108.6 grams) was added. Vigorous gasing and foaming took place, and some reflux was evident. After 2 hours between 55° and 60° C., the reaction temperature was increased to between 75° and 80° C. N,N-dimethylamino-2-ethanol (1.2 liters, 1,057 grams) was added and the reaction was allowed to proceed for 50 hours at 80° C. with continuous stirring. The hot solution was added to about 200 milliliters of methanol to precipitate a white polymer which was isolated by filtration, washed with additional methanol using a Waring blender, refiltered, and then vacuum dried to yield 625 grams of product, identified as the dimethylaminoethyl ester of NUCREL 599®. The product was polyethylene-3.4-mol percent-N,N-dimethylamino-2-ethylmethacrylate copolymer.

EXAMPLE V

Reaction of NUCREL 599®-Dimethylaminoethyl Ester with Para-Methyl Tosylate (26384-77):

The N,N-dimethylaminoethyl ester of NUCREL 599® (26384-73, 100 grams) and toluene (700 grams) were added to a 3-liter, 3-neck, round-bottom flask equipped with a mechanical stirrer, thermometer, water-cooled condenser and argon inlet. A silicone oil bath was used to heat the mixture to 80° C. and the polymer suddenly dissolved. P-methyl toluenesulfonate (24 grams) in toluene (200 grams) was added, and the reaction mixture was then heated and maintained at 100° C. for 43 hours with continuous stirring. The mixture was then allowed to cool to 25° C. and was filtered to isolate a fine-particulate, transparent polymeric gel which was twice washed with more toluene (1 liter) using a Waring blender. Filtration and air-drying yielded a white powder which was washed with methanol (1-liter), isolated by filtration and then air dried to yield 113.8 grams of product, identified as the adduct of NUCREL 599®-dimethylaminoethyl ester with p-methyl toluenesulfonate. The product was polyethylene- >2.2-mol percent-N,N,N-trimethylammonium-2-ethylmethacrylate p-toluenesulfonate copolymer.

EXAMPLE VI

Reaction of NUCREL 599, ®-Dimethylaminoethyl Ester with p-Toluenesulfonic Acid(26384-80):

The dimethylaminoethyl ester of NUCREL 599® (26384-73, 100.9 grams) and toluene (716.9 grams) were added to a 3-liter, 3-neck, round-bottom flask equipped with a mechanical stirrer, thermometer, water-cooled condenser and argon inlet. A silicone oil bath was used to heat the mixture to 115° C. (the polymer dissolved suddenly near 80° C.). p-Toluenesulfonic acid monohydrate (24.4 grams) was added at 115° C. and was washed into the reaction vessel with toluene (39.8 grams). The reaction mixture was maintained at 115° C. for 2 hours with continuous stirring. The mixture was then allowed to cool to 25° C. and was filtered to isolate a fine-particulate, transparent polymeric gel which was twice washed with more toluene (1 liter) using a Waring blender. Filtration and air drying yielded a white powder which was washed with methanol (1 liter), isolated by filtration and then vacuum dried to yield 111 grams of product, identified as the adduct of NUCREL 599®-dimethylaminoethyl ester with p-toluenesulfonic acid. The product was polyethylene >1.9-mol percent-N,N-dimethylammonium-2-ethyl-methacrylate hydrogen p-toluenesulfonate copolymer.

EXAMPLE VII

Reaction of NUCREL 599®-Dimethylaminoethyl Ester with Dinonylnaphthalenesulfonic Acid 26384-83):

The dimethylaminoethyl ester of NUCREL 599® (26384-73, 100.3 grams) and toluene (775 grams) were added to a 3-liter, 3-neck, round-bottom flask equipped with a mechanical stirrer, thermometer, water-cooled condenser and argon inlet. A silicone oil bath was used to heat the mixture to 70° C., at which temperature the polymer dissolved. Dinonylnaphthalenesulfonic acid (Nacure 1053, King Industries, Norwalk, Conn., 118.9 grams of a 50 weight percent solids solution in xylene) was added with toluene (83.8 grams) at 80° C. The reaction mixture was then heated and maintained at 100° C. for 2 hours with continuous stirring. The mixture was then allowed to cool to 25° C. The coagulated resin that formed on cooling was isolated by filtration, and added to methanol (1 liter) using a Waring blender to form a fine-particulate, unfilterable dispersion. The dispersion was then added to water (3 liters) to coagulate a polymer which was isolated by filtration, washed with methanol (1 liter) and then dried to yield 129.6 grams of product, identified as the adduct of NUCREL 599®-dimethylaminoethyl ester with dinonylnaphthalenesulfonic acid. The product was polyethylene- >1.9-mol percent-N,N-dimethylammonium-2-ethyl-methacrylate hydrogen dinonylnaphthalenesulfonate copolymer.

EXAMPLE VIII

Reaction of NUCREL 599®-Dimethylaminoethyl Ester with Hydrogen Bromide (26384-84):

Two reaction products from Runs 1 (45 grams) and 2 (50 grams) were combined and designated 26384-84.

Run 1

Toluene (300.4 grams) and NUCREL 599®-N,N-dimethylaminoethyl ester (26384-73, 50.3 grams) were combined in a glass-lined Parr-pressure reaction vessel (500 milliliters capacity), and hydrogen bromide was added from a lecture bottle until 1,000 psi was achieved. The vessel was then heated to 100° C. for 2 hours with stirring. The vessel was maintained at 1,000 psi with three additional charges of hydrogen bromide gas from the lecture bottle. After cooling to 25° C. and then cautious venting of unreacted gas, the resultant orange gel was washed with methanol using a Waring blender until a white product was obtained after filtration.

Run 2

Toluene (250 grams) and NUCREL 599®-dimethylaminoethyl ester (51.2 grams) were combined in a glass-lined Parr pressure reaction vessel (500 milliliters capacity), heated with stirring to 100° C., and then pressurized with hydrogen bromide gas from a lecture bottle until 800 psi was achieved. The pressure was maintained at 800 psi with two additional charges of hydrogen bromide gas from the lecture bottle. After 38 minutes, the vessel was cautiously vented and the warm solution was added to methanol (2-liters). The coagulated yellow polymer was isolated by filtration and washed repeatedly with methanol using a Waring blender until a white product was obtained, and the filtrate was colorless. All of the resin obtained from the above runs, run 1 about 47 grams and run 2 about 47 grams were combined and air dried to yield 95 grams of product identified as the adduct of NUCREL 599®-dimethylaminoethyl ester with hydrogen bromide. The product was polyethylene- >2.86-mol percent-N,N-dimethylammonium-2-ethylmethacrylate hydrogen bromide copolymer.

EXAMPLE IX

The 12-Liter Preparation of Polyethylene->1.2-mol percent-N,N,N-Trimethylammonium-2-Ethylmethacrylate p-Toluenesulfonate Copolymer 12-Liter Preparation of NUCREL 599®-Dimethylaminoethyl Ester (26384-85). A 12-liter round-bottom, 3-neck flask equipped with a reflux condenser, argon inlet, distillation take-off head, thermometer, glass stopper, and a mechanical stirrer was charged with NUCREL 599® (600 grams) and toluene (6 liters, 5213 grams). A heating mantle was used to heat the flask to remove 679 grams of distillate which was initially cloudy and then became clear. The reaction solution was then allowed to cool to 60° C. and oxalyl chloride (106.4 grams) was added. Within 2 minutes, vigorous gasing and foaming took place and some reflux was evident. After 2 hours at 60° C., the reaction temperature was increased to 85° C. Dimethylaminoethanol (1.2 liters, 1,101 grams) was added. The reaction mixture was then heated and maintained at 90° C. for 48 hours with continuous stirring. The hot solution was added to methanol (16 liters) to precipitate a white polymer which was isolated by filtration, washed with additional methanol using a Waring blender, refiltered, and then vacuum dried to yield 633 grams of product identified as the dimethylaminoethyl ester of NUCREL 599®. The product was polyethylene-3.4-mol percent-N,N-dimethylamino-2-ethylmethacrylate copolymer.

12-Liter Reaction of p-Methyl Tosylate and NUCREL 599®-Dimethylarninoethyl Ester (26384-87).

A 12-liter round-bottom, 3-neck flask equipped with a reflux condenser, argon inlet, distillation take-off head, thermometer, glass stopper, and a mechanical stirrer was charged with NUCREL 599®-dimethylaminoethyl ester (26384-85, 600 grams) and toluene (4,200 grams). A heating mantle was selected to heat the flask to 87° C. and some effervescence was observed. Methyl p-toluenesulfonate (154.9 grams) was added with toluene (36.6 grams) to wash the reagent into the vessel. The reaction mixture was then heated to 115° C. to remove 152 grams of distillate which was initially cloudy and then became clear. The reaction solution was then allowed to cool to 100° C. and was maintained there for 40 hours with continuous stirring. The mixture was then allowed to cool to 25° C., and the resultant, coagulated polymer was isolated by filtration as a fine-particulate, transparent polymeric gel which was twice washed with more toluene (4-liters) using a Waring blender. Filtration and air drying yielded a white powder which was washed with methanol (12-liters), isolated by filtration and then air dried to yield 645 grams of product, identified as the adduct of NUCREL 599®-dimethylaminoethyl ester with p-methyl toluenesulfonate. The product was polyethylene- >1.2-tool percent-N,N,N-trimethylammonium-2-ethylmethacrylate p-toluenesulfonate copolymer.

CHARGE DIRECTOR SYNTHESIS I

EXAMPLE X

Synthesis of Hydroxy Bis[3,5-di-t-Butyl Salicylic] Aluminate Monohydrate at Elevated Temperature To a solution of 12 grams (0.3 mole) of sodium hydroxide in 500 milliliters of water were added 50 grams (0.2 mole) of di-t-butyl salicylic acid. The resulting mixture was heated to 60° C. to dissolve the acid. A second solution was prepared by dissolving 33.37 grams (0.05 mole) of aluminum sulfate, $Al_2(SO_4)_3 \cdot 18H_2O$, into 200 milliliters of water with heating to 60° C. The former solution containing the sodium salicylate salt was added rapidly and dropwise into the latter aluminum sulfate salt solution with stirring. When the addition was complete, the reaction mixture was stirred an additional 5 to 10 minutes at 60° C. and then cooled to room temperature, about 25° C. The mixture was then filtered and the collected solid hydroxy bis[3,5-tert-butyl salicylic] aluminate monohydrate was washed with water until the acidity of the used wash water was about 5.5. The product was dried for 16 hours in a vacuum oven at 110° C. to afford 52 grams (0.096 mole, 96 percent theory) of a white powder of the above monohydrate, melting point of >300° C. When a sample, about 50 grams, of the hydroxy bis[3,5-di-t-butyl salicylic] aluminate monohydrate was analyzed for water of hydration by Karl-Fischer titration after drying for an additional 24 hours at 100° C. in a vacuum, the sample contained 2.1 percent weight of water. The theoretical value calculated for a monohydrate is 3.2 percent weight of water.

The infrared spectrum of the above product hydroxy bis[3,5-di-tertiary-butyl salicylic] aluminate monohydrate indicated the absence of peaks characteristic of the starting material di-t-butyl salicylic acid and indicated the presence of a AI-OH band characteristic at 3,660 $cm^{-1}$ and peaks characteristic of water of hydration.

NMR analysis for the hydroxy aluminate complex was obtained for carbon, hydrogen and aluminum nuclei and were all consistent with the above prepared monohydrate.

Elemental Analysis Calculated for $C_{30}H_{41}O_7Al$: C, 66.25; H, 7.62; AI, 5.52.

Calculated for $C_{30}H_{41}O_7Al—1H_2O$: C, 64.13; H, 7.74; AI, 4.81.

Found: C, 64.26; H, 8.11; Al, 4.67.

EXAMPLE XI

Synthesis of Hydroxy Bis[3,5-di-Tertiary-Butyl Salicylic] Aluminate Hydrate at Room Temperature The procedure of Charge Director Synthesis I, Example X, was repeated with the exception that the mixing of the two solutions and subsequent stirring was accomplished at room temperature, about 25° C. The product was isolated and dried as in Charge Director Synthesis I, and identified as the above hydroxy aluminum complex hydrate by infrared spectroscopy.

PREPARATION OF LID (Liquid Imersion Development Inks) INKS

CONTROL 1

Toner Containing No Charge Adjuvant (Toner 26788-2 No CCA Magenta)

177.2 Grams of NUCREL 599® (a copolymer of ethylene and methacrylic acid with a melt index at 190° C. of 500 available from E. I. DuPont de Nemours & Company, Wilmington, Del.), 50.0 grams of the magneta pigment (FANAL PINK TM), and 307.4 grams of NORPAR 15 TM (Exxon Corporation) were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 85° to 93° C. for 2 hours and cooled by running water through the attritor jacket to 14° C. with an additional 980.1 grams of NORPAR 15 TM added and ground in the attritor for an additional 7.5 hours. An additional 1,517 grams of NORPAR 15 TM were added and the mixture was separated from the steel balls yielding a toner concentrate of 7.21 percent solids of 78 weight percent NUCREL 599® toner resin, and 22 weight percent magenta pigment. A sample of the toner concentrate (27.74 grams at 7.21 weight percent solids) was diluted to 1 weight percent solids by the addition of 172.26 grams of NORPAR 15 TM, and was charged by the addition of 0.2 gram of hydroxy bis[3,5-di-tertiary-butyl salicylic] aluminate hydrate (Example XI) charge director. A second 200 gram sample of the 1 percent solids toner, prepared as described above, was charged by the addition of 0.1 gram of hydroxy bis[3,5-di-tertiary-butyl salicylic] aluminate hydrate (Example XI) and 0.1 gram of EMPHOS PS-900 TM (Witco) charge director. The conductivity and mobility of these samples were measured. The results are presented in Table 1. A third sample of toner was prepared by taking 194.2 grams of the 7.21 weight percent toner concentrate and mixing it with 1,170.8 grams of NORPAR 15 TM and 35 grams of a 4 percent by weight 1:1 mixture of hydroxy bis[3,5-di-tertiary-butyl salicylic] aluminate hydrate (Example XI) and EMPHOS PS-900 TM (Witco). This sample was image quality tested in a Savin 870 copier. The results are in Table 2.

EXAMPLE XII 26788-10 Magenta Toner Containing Resin that was 50 Percent NUCREL 599 ® and 50 Percent 26384-77, the Adduct of Methyl p-Toluenesulfonate and the Dimethylaminoethyl Ester of NUCREL 599 ®, Polyethylene->2.2mol Percent-N,N,N-trimethylammonium-2-ethyl-methacrylate p-Toluenesulfonate Copolymer 88.6 Grams of NUCREL 599 ® (a copolymer of ethylene and methacrylic acid with a melt index at 190° C. of 500 available from E. I. DuPont de Nemours & Company, Wilmington, Del.), 50.0 grams of the magenta pigment (FANAL PINK TM), 88.6 grams of the charge adjuvant or charge additive of Example V, and 307.4 grams of NORPAR 15 TM (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 85° to 93° C. for 2 hours and cooled by running water through the attritor jacket to 16° C. with an additional 980.1 grams of NORPAR 15 TM added and ground in the attritor for an additional 6.5 hours. An additional 1,517 grams of NORPAR 15 TM were added and the mixture was separated from the steel balls yielding a toner concentrate of 7.22 percent solids wherein the solids contained 39 weight percent of NUCREL 599 ® toner resin, 22 weight percent of magenta pigment, and 39 weight percent of the additive of Example V. A 200 gram sample of 1 percent solids toner was made by diluting 27.7 grams of toner concentrate at 7.22 weight percent solids with 172.3 grams of NORPAR 15 TM and was charged by the addition of 0.2 gram of hydroxy bis[3,5-di-tertiary-butyl salicylic] aluminate hydrate (Example XI) charge director. A second 200 gram sample of this 1 percent solids toner was made and charged by the addition of 0.1 gram of hydroxy bis[3,5-di-tertiary-butyl salicylic] aluminate hydrate (Example XI) and 0.1 gram of EMPHOS PS-900 TM (Witco) charge director. The conductivity and mobility of these samples were measured. The results are presented in Table 1. A third sample of toner was prepared by taking 193.9 grams of the 7.22 weight percent toner concentrate and mixing it with 1,171.1 grams of NORPAR 15 TM and 35 grams of a 4 percent by weight 1:1 mixture of hydroxy bis[3,5-di-tertiary-butyl salicylic] aluminate hydrate (Example XI) and EMPHOS PS-900 TM (Witco). This sample was image quality tested in a Savin 870 copier. The results are presented in Table 2.

EXAMPLE XIII 26788-12 Magenta Toner Containing Resin that was 50 Percent NUCREL 599 ® and 50 Percent 26384-80, the Adduct of Toluenesulfonic Acid and Dimethyl Amine of NUCREL 599 ®, Polyethylene->1.9-mol Percent-N,N-dimethylammonium-2-ethyl-methacrylate Hydrogen p-Toluenesulfonate Copolymer 88.6 Grams of NUCREL 599 ® (a copolymer of ethylene and methacrylic acid with a melt index at 190° C. of 500 available from E. I. DuPont de Nemours & Company, Wilmington, Del.), 50.0 grams of the magenta pigment (FANAL PINK TM), 88.6 grams of additive from Example VI, and 307.4 grams of NORPAR 15 TM (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 92° to 102° C. for 2 hours and cooled by running water through the attritor jacket to 21° C. with an additional 980.1 grams of NORPAR 15 TM added and ground in the attritor for an additional 5.0 hours. An additional 1,508 grams of NORPAR 15 TM were added and the mixture was separated from the steel balls yielding a toner concentrate of 6.89 percent solids wherein the solids consisted of 39 weight percent of NUCREL 599 ® toner resin, 22 weight percent of magenta pigment, and 39 weight percent of additive of Example VI. A sample (29.03 grams of toner concentrate at 6.89weight percent solids) was diluted with 170.97 grams of NORPAR 15 TM to yield 200 grams of 1 weight percent solids toner which was charged by the addition of 0.2 gram of hydroxy bis[3,5-di-tertiary-butyl salicylic] aluminate hydrate (Example XI) charge director. A second sample (200 grams) of this 1 percent solids toner was made and then charged by the addition of 0.1 gram of hydroxy bis[3,5-di-tertiary-butyl salicylic] aluminate hydrate (Example XI) and 0.1 gram of EMPHOS PS-900 TM (Witco) charge director. The conductivity and mobility of these samples were measured. The results are presented in Table 1.

EXAMPLE XIV 26788-15 Magenta Toner Containing Resin that was 50 Percent NUCREL 599 ® and 50 Percent 26384-83, the Adduct of Dinonylnaphthalenesulfonic Acid and Dimethylaminoethyl Ester of NUCREL 599 ®, Polyethylene->1.9-mol Percent-N,N-dimethylammonium-2-ethyl-methacrylate Hydrogen Dinonylnaphthalenesulfonate Copolymer 88.6 Grams of NUCREL 599 ® (a copolymer of ethylene and methacrylic acid with a melt index at 190° C. of 500 available from E. I. DuPont de Nemours & Company, Wilmington, Del.), 50.0 grams of the magenta pigment (FANAL PINK TM), 88.6 grams of additive from Example VII, and 307.4 grams of NORPAR 15 TM (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 87° to 92° C. for 2 hours and cooled by running water through the attritor jacket to 15° C. with an additional 980.1 grams of NORPAR 15 TM added and ground in the attritor for an additional 4.5 hours. An additional 1,494 grams of NORPAR 15 TM were added and the mixture was separated from the steel balls yielding a toner concentrate of 7.27 percent solids wherein the solids contained 39 weight percent of NUCREL 599 ® toner resin, 22 weight percent of magenta pigment, and 39 weight percent of additive from Example VII. A sample of the toner concentrate (27.51 grams at 7.27 weight percent solids) was diluted with NORPAR 15 TM (172.49 grams) to yield 200 grams of a 1 percent solids toner which was charged by the addition of 0.2 gram of hydroxy bis[3,5-di-tertiary-butyl salicylic]-aluminate hydrate (Example XI) charge director. A second 200 gram sample of this 1 percent solids toner was charged by the addition of 0.1 gram of hydroxy bis[3,5-di-tertiary-butyl salicylic] aluminate hydrate (Example XI) and 0.1 gram of EMPHOS PS-900 TM (Witco) charge director. The conductivity and mobility of these samples were measured. The results are presented in Table 1.

EXAMPLE XV sample of this 1 percent solids toner was charged by the addition of 0.2 gram of hydroxy bis[3,5-di-tertiary-butyl salicylic] aluminate hydrate (Example XI) charge director. A second 200 gram sample of this 1 percent solids toner was charged by the addition of 0.1 gram of hydroxy bis[3,5-di-tertiary-butyl salicylic] aluminate hydrate (Example XI) and 0.1 gram of EMPHOS PS-900 TM (Witco) charge director. The conductivity and mobility of these samples were measured. The results are presented in Table 1.

TABLE 1

| EXAMPLE | Additive | Charge Director | Particle Radius by Area (microns) | Mobility (10-10 $m^2/Vs$) | Zeta Potential (mV) | Conductivity (ps/cm) |
|---|---|---|---|---|---|---|
| Control 1 | None | Example XI | 0.91 | 1.23 | 81 | 14 |
| Control 1 | None | 1:1 Example XI: Emphos PS900 | 0.91 | 1.48 | 98 | 4 |
| Example XII | Example V | Example XI | 0.59 | 0.62 | 30 | 55 |
| Example XII | Example V | 1:1 Example XI: Emphos PS900 | 0.59 | 3.44 | 160 | 7 |
| Example XIII | Example VI | Example XI | 0.60 | 0.69 | 34 | 49 |
| Example XIII | Example VI | 1:1 Example XI: Emphos PS900 | 0.60 | 2.91 | 143 | 6 |
| Example XIV | Example VII | Example XI | 0.46 | 2.39 | 98 | 32 |
| Example XIV | Example VII | 1:1 Example XI: Emphos PS900 | 0.46 | 2.99 | 122 | 7 |
| Example XV | Example VIII | Example XI | 0.44 | 2.31 | 92 | 25 |
| Example XV | Example VIII | 1:1 Example XI: Emphos PS900 | 0.44 | 2.47 | 99 | 6 |

26788-17 Magenta Toner Containing Resin that was 50 Percent NUCREL 599 ® and 50 Percent 26384-84, the Adduct of HBr and Dimethylaminoethyl Ester of NUCREL 599 ®, Polyethylene- >2.86-mol Percent-N,N-dimethylammonium-2-ethylmethacrylate Hydrogen Bromide Copolymer 88.6 Grams of NUCREL 599 ® (a copolymer of ethylene and methacrylic acid with a melt index at 190° C. of 500 available from E. I. DuPont de Nemours & Company, Wilmington, Del.), 50.0 grams of the magenta pigment (FANAL PINK TM), 88.6 grams of additive from Example VIII, and 307.4 grams of NORPAR 15 TM (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 86° to 97° C. for 2 hours and cooled by running water through the attritor jacket to 20° C. with an additional 980.1 grams of NORPAR 15 TM added and ground in the attritor for an additional 4.5 hours. An additional 1,506 grams of NORPAR 15 TM were added and the mixture was separated from the steel balls yielding a toner concentrate of 7.15 percent solids wherein the solids consisted of 39 weight percent of NUCREL 599 ® toner resin, 22 weight percent of magenta pigment, and 39 weight percent of additive from Example VIII. A 200 gram

TABLE 2

| EXAMPLE | Additive | Charge Director | Print Density |
|---|---|---|---|
| Control 1 | None | 1:1 Example XI: Emphos PS900 | 1.36 |
| Example XII | Example V | 1:1 Example XI: Emphos PS900 | 1.68 |

CONTROL 2

Preparation of Cyan LID Ink Made with NUCREL 599 ®-Dimethylaminoethyl Ester (26384-13), i.e., Polyethylene-3,4-mol Percent-dimethylaminoethyl Methacrylate Copolymer Resin (26383-104, polyethylene-3.4-mol percent-dimethylaminoethyl methacrylate copolymer, 5.25 grams), PV FAST BLUE TM (1.35 grams) and ISOPAR L TM (170 grams) were heated in a Union Process O1 attritor containing 2,400 gram stainlesss steel 3/16 inch chrome-coated shot until 200° F. was achieved. After 10 minutes, heating was discontinued and ambient temperature stirring was maintained for 2 hours. Water cooling with stirring was then continued for 4 more hours. The ink was allowed to flow off the shot using a strainer, and the calculated weight percent solids of the resultant ink was 3.74. The determined weight percent solids, which consisted of 79.55 weight percent polyethylene-3.4-mol percent-dimethylaminoethyl methacrylate copolymer and 20.45 weight percent of PV FAST BLUE TM, was 3.66, as determined by loss on drying using a sun lamp heat source for 24 hours. The ink concentrate (54.64 grams at 3.66 weight percent solids) was diluted with ISOPAR L TM (145.36 grams) to yield 200 grams of 1 weight percent solids toner. This toner at 1 weight percent solids with 30 milligrams of aluminum complex charge director (Example XI) per grams of ink solids had an ESA electrophoretic mobility of $1.57\times10-11$ $M^2/V$.second, a zeta potential of 4.2 millivolts, and a low conductivity of 2 pmho/centimeter. When a 1 weight percent ink was prepared with 50 milligrams/gram of resin HBr-Quat charge director (a group transfer polymerized block copolymer of dimethylaminoethyl methacrylate and 2-methyl-hexyl methacrylate treated with HBr, reference U.S. Ser. No. 065,414 (D/92560), Example IV, the ESA electrophoretic mobility was $-1.03\times10^{-10}$ $M^2/V$-second, the zeta potential was $-31.7$ millivolts, and the conductivity was 20 pmho/centimeter. The average radius (area) of the particles (by Horiba CAPA 500) was 0.385 micron.

EXAMPLE XVI

Preparation of Cyan LID Ink Made with NUCREL 599 ®-Trimethylammonium-Ethyl Ester Bromide (26384-11), i.e., Polyethylene-N,N,N-trimethylammonium-2-ethylmethacrylate Bromide Copolymer Resin (26384-10, polyethylene-N,N,N-trimethylammonium-2-ethylmethacrylate bromide copolymer, 15.58 grams), PV FAST BLUE TM (3.895 grams) and 15OPAR L TM (170 grams) were heated in a Union Process O1 attritor containing 2,400 grams of stainless steel 3/16-inch chrome-coated shot until 200° F. was achieved. After 10 minutes, heating was discontinued and ambient temperature stirring was maintained 2 hours. Water cooling with stirring was then continued for 4 more hours. The ink was washed from the shot with 380 grams of 15OPAR L TM using a strainer, and the calculated weight percent solids of the resultant ink was 3.42. The determined weight percent solids consisting of 80 percent of resin and 20 percent of PV FAST BLUE TM was 3.45 as determined by loss on drying using a sun lamp heat source for 24 hours. This ink at 1 weight percent solids, which was prepared by diluting 57.97 grams of 3.45 weight percent solids ink with 142.03 grams of ISOPAR L TM, with 30 milligrams of aluminuim complex charge director (Example XI) per grams of ink solids had an ESA electrophoretic mobility of $5.78\times10-10$ $M^2/V$-second, a zeta potential of 304.4 millivolts, and a low conductivity of 6 pmho/centimeter. The average radius (area) of the particles (by Horiba CAPA 500) was 0.965 micron.

In embodiments, the copolymer charge adjuvant can be utilized with a mixture of a second charge adjuvant, such as aluminum stearate present in an amount of from about 1 to about 10, and preferably about 3 weight percent. Further, in embodiments the thermoplastic resin particles may be avoided.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A positively charged liquid developer a liquid carrier thermoplastic resin particles, optional pigment, a charge director, and a charge adjuvant comprised of a polymer of an alkene and unsaturated acid derivative, and wherein the charge adjuvant is associated with or combined with said resin and said optional pigment, and wherein the charge adjuvant is a copolymer of ethylene and methacrylic acid ester, and wherein said ester group contains covalently bonded thereto pendant ammonium groups.

2. A positively charged liquid electrostatographic developer comprised of (A) a liquid with a viscosity of from about 0.5 to about 20 centipoise and resistivity greater than or equal to about $5\times10^9$ ohm-cm; (B) thermoplastic resin particles with an average volume particle diameter of from about 0.1 to about 30 microns, and pigment; (C) insoluble charge adjuvant comprised of a copolymer of ethylene and an $\alpha$-$\beta$-ethylenically unsaturated acid selected from the group consisting of acrylic acid and methacrylic acid derivatives, and which copolymer contains pendant ammonium groups covalently bonded to said acid derivatives; and (D) a charge director; and wherein the charge adjuvant is associated with or combined with said resin and said pigment; and wherein the charge adjuvant is selected from the group consisting of ethylene and N,N,N-trimethylammonium-2-ethylmethacrylate bromide, ethylene and N,N,N-trimethylammonium-2-ethylmethacrylate tosylate, ethylene and N,N-dimethylammonium-2-ethylmethacrylate hydrogen bromide, ethylene and N,N-dimethylammonium-2-ethylmethacrylate hydrogen dinonylnaphthalenesulfonate, and ethylene and N,N-dimethylammonium-2-ethyl methacrylate hydrogen tosylate.

3. A developer in accordance with claim 2 wherein component (A) is present in an amount of from about 85 percent to about 99.9 percent by weight, based on the total weight of the liquid developer, the total weight of developer solids is from about 0.1 percent to about 15 percent by weight, and component (D) is present in an amount of from about 5 to about 1,000 milligrams/gram developer solids.

4. A developer in accordance with claim 2 wherein component (C) is present in an amount of from about 1 to about 100 percent by weight of developer solids.

5. A developer in accordance with claim 2 wherein component (D) is a metal soap.

6. A developer in accordance with claim 2 wherein component (D)is an aluminum soap or a sodium salt of phosphated mono-and diglycerides with saturated and unsaturated substituents.

7. A developer in accordance with claim 2 wherein component (D) is an alkyl salicylic acid aluminum complex.

8. A developer in accordance with claim 2 wherein component (D) is a hydroxy bis(3,5-di-tert-butyl salicyclic) aluminate monohydrate.

9. A developer in accordance with claim 2 wherein component (D) is comprised of a mixture of hydroxy bis(3,5-di-tert-butyl salicyclic) aluminate monohydrate and an anionic complex organic phosphate ester.

10. A developer in accordance with claim 2 wherein from about zero (0) to about 90 percent by weight of said thermoplastic resin particles are present.

11. A positively charged liquid developer a liquid carrier, thermoplastic resin particles, optional pigment, a charge director, and a charge adjuvant comprised of a polymer of an alkene and unsaturated acid derivative, and wherein the acid derivative contains pendant ammonium groups covalently bonded to said acid derivative, and wherein the charge adjuvant is associated with or combined with said resin and said optional pigment, and wherein the charge adjuvant is a copolymer of ethylene and N,N,N-trimethylammonium-2-ethylmethacrylate bromide.

12. A positively charged liquid developer a liquid carrier, thermoplastic resin particles, optional pigment, a charge director, and a charge adjuvant comprised of a polymer of an alkene and unsaturated acid derivative, and wherein the acid derivative contains pendant ammonium groups covalently bonded to said acid derivative, and wherein the charge adjuvant is associated with or combined with said resin and said optional pigment, and wherein the charge adjuvant is a copolymer of ethylene and N,N,N-trimethylammonium-2-ethylmethacrylate tosylate.

13. A positively charged liquid developer a liquid carrier thermoplastic resin particles, optional pigment, a charge director, and a charge adjuvant comprised of a polymer of an alkene and unsaturated acid derivative, and wherein the acid derivative contains pendant ammonium groups covalently bonded to said acid derivative, and wherein the charge adjuvant is associated with or combined with said resin and said optional pigment, and wherein the charge adjuvant is a copolymer of ethylene and N,N-dimethylammonium-2-ethylmethacrylate hydrogen bromide.

14. A positively charged liquid developer a liquid carrier, thermoplastic resin particles, optional pigment, a charge director, and a charge adjuvant comprised of a polymer of an alkene and unsaturated acid derivative, and wherein the acid derivative contains pendant ammonium groups covalently bonded to said acid derivative, and wherein the charge adjuvant is associated with or combined with said resin and said optional pigment, and wherein the charge adjuvant is a copolymer of ethylene and N,N-dimethylammonium-2-ethylmethacrylate hydrogen dinonylnaphthalenesulfonate.

15. A positively charged liquid developer a liquid carrier, thermoplastic resin particles, optional pigment, a charge director, and a charge adjuvant comprised of a polymer of an alkene and unsaturated acid derivative, and wherein the acid derivative contains pendant ammonium groups covalently bonded to said acid derivative, and wherein the charge adjuvant is associated with or combined with said resin and said optional pigment, and wherein the charge adjuvant is a copolymer of ethylene and N,N-dimethylammonium-2-ethylmethacrylate hydrogen tosylate.

* * * * *